US005669325A

United States Patent [19]

Feikema

[11] Patent Number: 5,669,325

[45] Date of Patent: Sep. 23, 1997

[54] MARINE RADAR ARCH

[76] Inventor: Orville A. Feikema, 6805 Riverview Blvd. W., Bradenton, Fla. 34209

[21] Appl. No.: 683,846

[22] Filed: Jul. 19, 1996

[51] Int. Cl.[6] ..... B63B 17/00

[52] U.S. Cl. ..... 114/343; 114/364

[58] Field of Search ..... D12/317; 114/343, 114/364, 270, 357, 273, 272; 296/10, 163; 280/756

[56] References Cited

U.S. PATENT DOCUMENTS

| | | | |
|---|---|---|---|
| D. 284,754 | 7/1986 | Shields . | |
| 3,905,449 | 9/1975 | Uphoff | 280/756 |
| 3,990,738 | 11/1976 | Kolinger et al. | 280/756 |
| 4,515,393 | 5/1985 | Sauter | 280/756 |
| 4,694,773 | 9/1987 | Sparkes et al. . | |
| 4,951,594 | 8/1990 | Feikema . | |
| 5,052,326 | 10/1991 | Wiggen et al. | 114/364 |

*Primary Examiner*—Edwin L. Swinehart
*Attorney, Agent, or Firm*—Charles J. Prescott

[57] ABSTRACT

A radar arch for connection onto a deck or superstructure of a boat adapted to supportively receive various pieces of boat equipment and convertible top components. The radar arch includes an arch member having a generally inverted U-shaped configuration formed of molded inner and outer fiberglass components which are connected together along mating seams. The arch member is generally comprised of a transverse upper portion which spans the boat laterally and downwardly extending side portions which supportively engage the deck or superstructure of the boat. A stiffening enlargement is integrally formed into each upper corner of the inner portion of the arch which greatly stiffens this area to substantially reduce lateral racking of the arch in rough seas. Each of these stiffening enlargements which are unobtrusively contoured and blended into the overall arch configuration, may also be used for mounting boat equipment such as deck lights, speakers and the like or simply as small overhead storage areas.

4 Claims, 3 Drawing Sheets

MARINE RADAR ARCH

BACKGROUND OF THE INVENTION

SCOPE OF INVENTION

This invention relates generally to overhead radar arches for boats and more particularly to a radar arch formed of molded fiberglass or plastic having structural features which substantially reduce the tendency of such radar arches to rack or shake laterally in rough sea conditions.

PRIOR ART

Radar arches for boats which are attached either to the deck area of an open boat or to the superstructure of a fly bridge style boat are quite popular. These radar arches add a very distinctly decorative overhead structure for supporting boat equipment such as antennas, radar transmitters, deck lights, stereo speakers and the like.

Typically, these radar arches are constructed of either aluminum panels or molded fiberglass components. Radar arches which are fabricated of aluminum are generally more costly and much more restrictive in terms of styling. Fiberglass radar arches are less costly to manufacture and impose virtually no restrictions on the styling and design thereof.

Typically, fiberglass radar arches are fabricated from two molded components, an inner and an outer portion which are fiberglassed together at their mating seams, typically at the leading and trailing edges of the arch member. By this structural arrangement, the interior of the radar arch is hollow for both weight reduction and for supporting and enclosing pieces of boat equipment and wiring therefor.

With the above advantages of fiberglass radar arches in mind when compared to aluminum arches, these fiberglass arches have a structural weakness in that they are not as rigid and stable laterally. That is to say, in rough seas, boat-to-wave impacts, especially at higher boat speeds, tend to result in the shaking of the radar arch from side to side known as "racking" in that the lower ends of the arch connected to the deck or superstructure remain stationary while the upper portions of the arch encounter substantial lateral movement. The movement increases in proportion to the distance above the mounting surface, the upper transverse portion of the radar arch which laterally spans the boat experiences the greatest amount of movement.

Several prior U.S. Patent teach such conventional fiberglass radar arches such as in my previous U.S. Pat. No. 4,951,594, in U.S. Pat. No. 4,694,773 invented by Sparkes and in U.S. Pat. No. Des. 284,754 invented by Shields.

This racking has several detrimental effects. First, the racking movement is visible and may easily be felt which is discouraging to the boat owner who may view this racking movement as representative of inferior construction quality. Additionally, boat equipment which is mounted on and within the radar arch experiences excessive shaking which may be detrimental. The radar transmitter mounted atop the radar thus may be most detrimentally effected as a result of this racking movement. Moreover, should the racking of the radar arch become excessive and for a sufficient amount of time, the upper corners of the radar arch may begin to fatigue, crack and break.

One means of eliminating this problem is the installation of metal diagonal braces mounted on the underside of the arch between the upper transverse portion of the arch and each upright side portion. This substantially stiffens these upper corners of the arch member, which corners flex excessively and have been identified as a primary source of racking. Although aesthetically offensive and possibly presenting an interference to passenger movement beneath the arch, this bracing remedy is effective in eliminating racking.

The present invention modifies the inside upper corner of the inner fiberglass molded half of the radar arch by providing an enlargement which is integrally molded into each inside corner in an aesthetically pleasing way, yet rigidizing this area of the radar arch to substantially reduce racking. Additionally, the enlargement is structured and contoured for mounting various pieces of boat equipment such as lights, speakers, horns and the like or alternately to simply provide an additional storage area accessible through an opening formed in one surface thereof.

BRIEF SUMMARY OF THE INVENTION

This invention is directed to a radar arch for connection onto a deck or superstructure of a boat adapted to supportively receive various pieces of boat equipment and convertible top components. The radar arch includes an arch member having a generally inverted U-shaped configuration formed of molded inner and outer fiberglass components which are connected together along mating seams. The arch member is generally comprised of a transverse upper portion which spans the boat laterally and downwardly extending side portions which supportively engage the deck or superstructure of the boat. A stiffening enlargement is integrally formed into each upper corner of the inner portion of the arch which greatly stiffens this area to substantially reduce lateral racking of the arch in rough seas. Each of these stiffening enlargements which are unobtrusively contoured and blended into the overall arch configuration, may also be used for mounting boat equipment such as deck lights, speakers and the like or simply as small overhead storage areas.

It is therefore an object of this invention to provide an improved boat radar arch formed of molded fiberglass components for economy and which substantially resists the tendency to rack laterally in rough seas.

It is another object of this invention to provide an improved radar arch for a boat which is made of fiberglass inner and outer bonded portions for economy and which includes an enlarged upper corner contoured structure for substantially reducing lateral shake of the radar arch in rough seas and which further provides either additional storage area or mounting areas for boat equipment such as lights, audio speakers, horns and the like.

It is still another object of this invention to provide a molded fiberglass radar arch for a boat with enhanced lateral rigidity to resist racking in rough seas in an aesthetically unobtrusive way.

In accordance with these and other objects which will become apparent hereinafter, the instant invention will now be described with reference to the accompanying drawings.

DETAILED DESCRIPTION OF THE INVENTION

Figure 5:
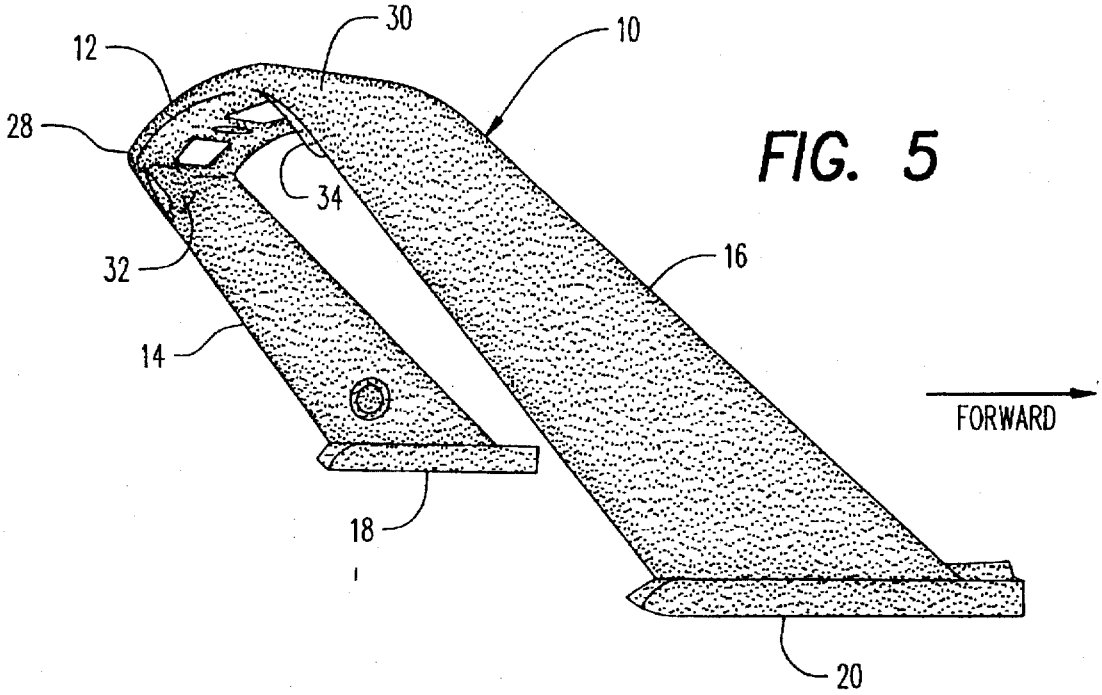
FIG. 5 is a side perspective view of the invention of FIG. 1.
Figure 6:
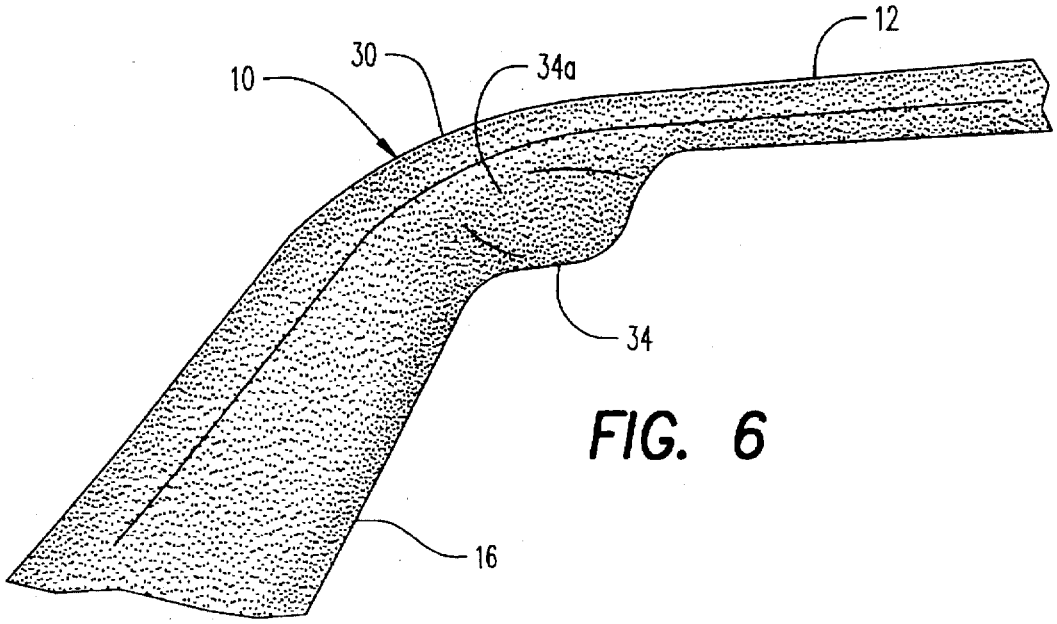
FIG. 6 is a front perspective view of the right hand portion of the invention shown in FIG. 1.

Referring now to the drawings, one embodiment of the invention is shown generally at numeral 10 in FIGS. 1, 2, 5 and 6. The other embodiments all include the same radar arch improved structure and contoured upper corners, however. The arch member 10 includes a transverse upper portion 12 which is sized to generally span a width of a boat at its deck attachment or superstructure attachment areas. The arch member 10 also includes integrally molded downwardly extending side portions 14 and 16 which are structured for supportive interconnection at their bottom ends 18 and 20 with the boat deck or superstructure such as a flybridge of a boat. For reference as seen in FIG. 5, the forward portion of the boat is indicated by the arrow. Thus, the preferred embodiment 10 is of a "raked" back design wherein both leading and trailing edges of the arch member 10 are generally sloped rearwardly. However, such an arch member may also be substantially upright or raked forwardly and is within the intended scope of this invention although not specifically shown.

Figure 4:
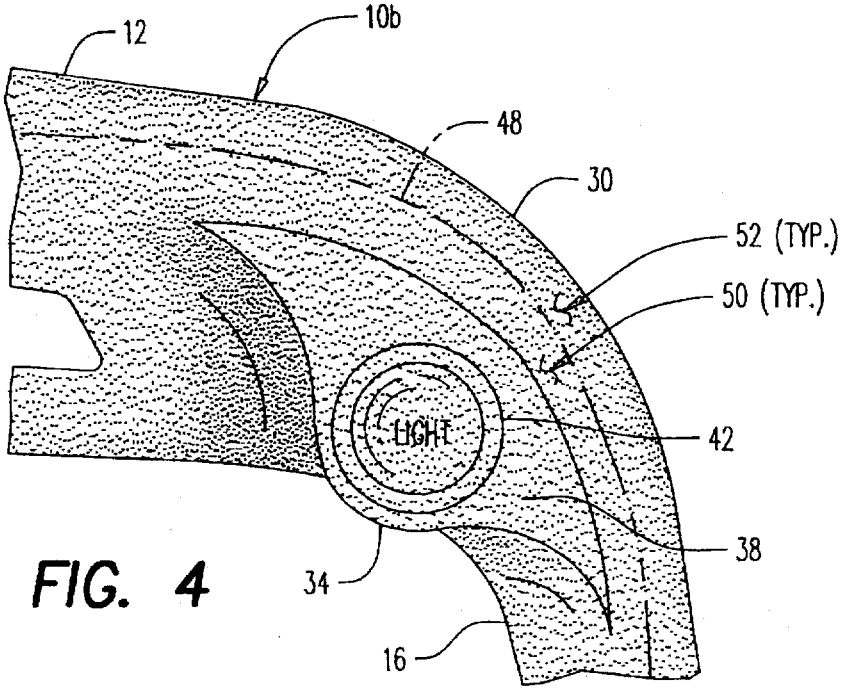
FIG. 4 is an enlarged view similar to that of FIG. 3 showing yet another embodiment of the invention.

As seen in FIG. 4, a typical molded fiberglass radar arch such as at lob is formed of molded inner and outer components 50 and 52, respectively which are fiberglassed together along their mating margins shown in phantom at 48. These mating margins 48 are typically positioned along the leading and trailing edges of the arch **10*b* as shown. This generally provides a hollow structure having equipment compartments 22, 24, 26 and 27** and the like as seen in the various figures into which such boat equipment as speakers, lights, navigational equipment and the like may be installed or alternately used for storage.

Figure 1:
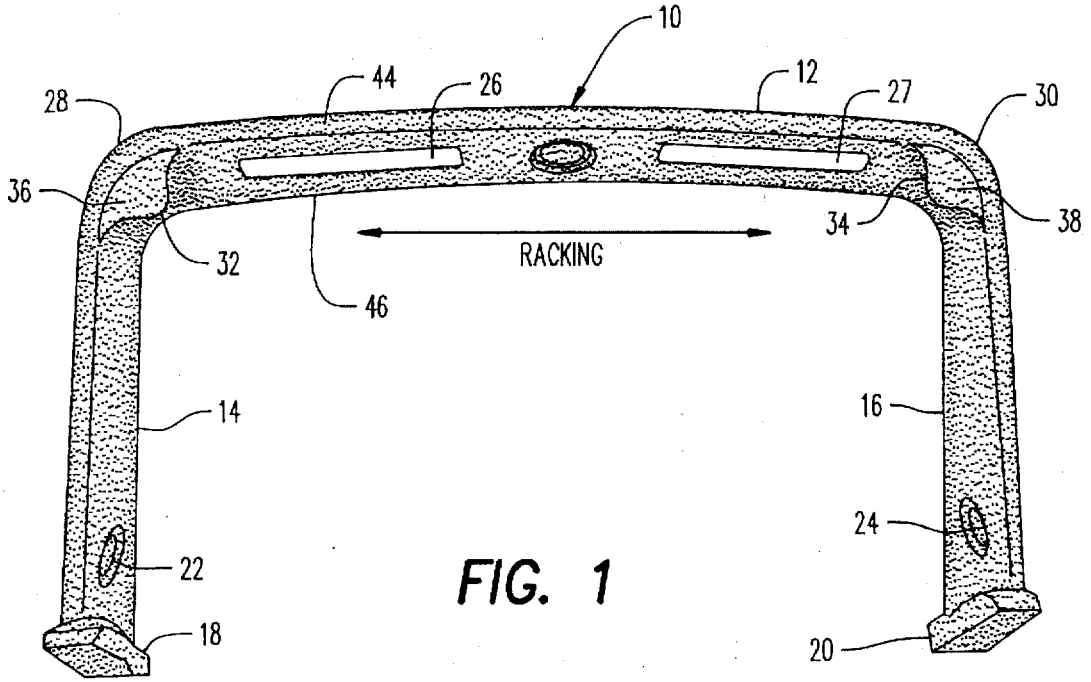
FIG. 1 is a rear perspective view of one embodiment of the invention.
Figure 2:
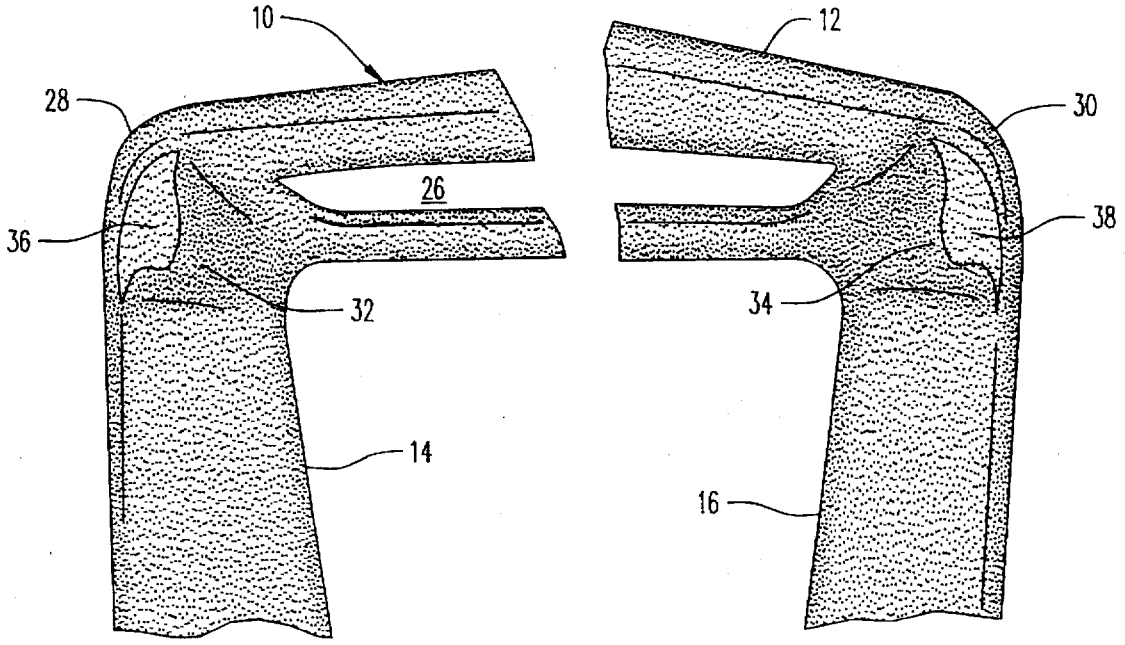
FIG. 2 is an enlarged broken view of FIG. 1.

As seen in FIG. 1, the problem of racking is depicted by the arrow wherein the upper portion 12 moves or shakes laterally with respect to the boat and the lower mounting members 18 and 20 as when the boat encounters rough seas. It is this problem of racking which the invention primarily addresses by providing smoothly contoured stiffening enlargements or reinforcements 32 and 34 positioned and integrally molded into the inside upper corners of inner component 50 as in FIG. 4 of the arch member.

These stiffening enlargements 32 and 34 are preferably somewhat conical in shape as shown in that they uniformly enlarge from the leading edge to the trailing edge of the upper corners of the radar arch 10, terminating in a generally upright flat surface 36 and 38. Thus, as seen in FIGS. 1, 2, 5 and 6, one embodiment of the invention 10, the simplest form, only includes these stiffening enlargements 32 and 34. These stiffening enlargements 32 and 34, are again, molded directly into the inner fiberglass arch component 50 prior to being connected to the mating molded fiberglass outer components 52.

It is these stiffening enlargements 32 and 34 which provide substantially increased rigidity of these upper corners 28 and 30 of the arch member 12 to substantially reduce, if not completely eliminate, the racking problem which this invention directly addresses.

Figure 3:
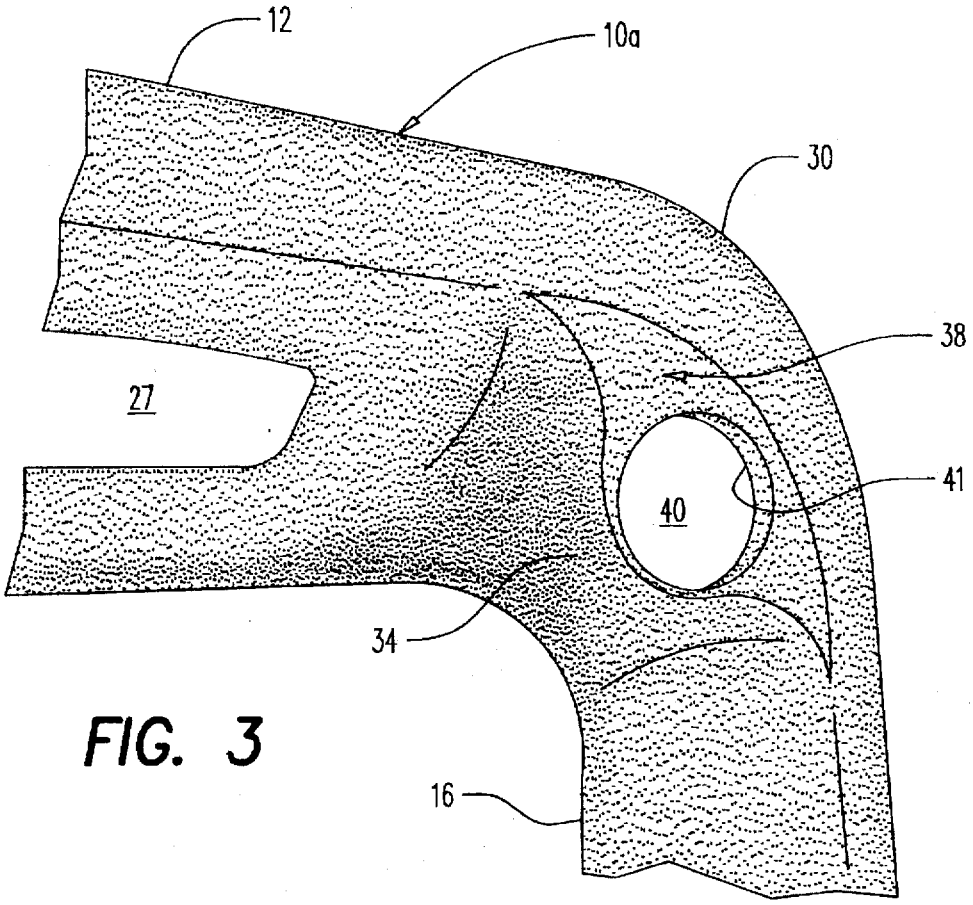
FIG. 3 is a further enlarged view of a portion of an alternate embodiment of the invention shown in FIG. 1.

Because these stiffening enlargements 32 and 34 create a substantial hollow cavity, which may be used to provide a storage area 40 as shown in FIG. 3 which may be as simple as forming a suitable aperture 41 through the upright flat panel 38. Preferably as FIG. 4, a rearwardly directed light 42 is shown installed into a suitably prepared aperture formed into upright panel 38 for lighting the back deck of the boat and to assist in docking maneuvers at night. Obviously, each of the stiffening enlargements 32 and 34 are of sufficient size to accommodate many other smaller pieces of boat equipment and it is not the intention of this disclosure to describe all of them as being obvious variations.

Although the preferred general embodiment of the invention is as shown having a sculptured or contoured conical shape enlarging rearwardly, nonetheless the outer contour of these stiffening enlargements of the inner surfaces of the upper corners of the arch member may also be uniform from front to back or be conically enlarging toward the front of the radar arch and be within the scope of this invention although not specifically shown.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A radar arch structure for connection onto a deck or superstructure of a boat comprising:

a rigid arch member formed of molded fiberglass or plastic and having a generally inverted U-shaped configuration, a leading edge and a trailing edge, and including a transverse upper portion generally spanning the width of the deck or superstructure and a pair of downwardly extending side portions each structured at its lower end for connection to the deck or superstructure;

a substantially enlarged stiffening portion of said arch member positioned and extending inwardly from an inner surface of each upper corner of said arch member, each said corner positioned and smoothly contoured between said upper portion and each said side portion and defining an enclosed volume for storage or for mounting a piece of boat equipment thereon;

each said enlarged stiffening portion substantially increasing the strength and rigidity of each said corner whereby a tendency of said upper portion to rack or move laterally with respect to each said lower end is substantially reduced.

2. A radar arch structure for connection onto a deck or superstructure of a boat comprising:

a rigid arch member formed of molded fiberglass or plastic inner and outer halves which are joined together along mating margins, said arch member having a generally inverted U-shaped configuration, a leading edge and a trailing edge, and including a transverse upper portion generally spanning the width of the deck or superstructure and a pair of downwardly extending side portions each structured at its lower end for connection to the deck or superstructure;

contoured stiffening means integrally molded and surface blended into an inner corner surface of said inner half for substantially reducing a tendency of said arch member to rack laterally when the boat encounters rough water and for defining an enclosed volume for storage or for receiving a piece of boat equipment therein.

3. A radar arch structure for connection onto a deck or superstructure of a boat comprising:

a rigid arch member formed of molded fiberglass or plastic inner and outer halves which are joined together along mating margins, said arch member having a generally inverted U-shaped configuration, a leading edge and a trailing edge, and including a transverse upper portion generally spanning the width of the deck or superstructure and a pair of downwardly extending side portions each structured at its lower end for connection to the deck or superstructure;

compartment means defined between an enlargement of each inside corner surface of said inner half and each outside corner of said outer half for providing a surface and enclosed volume for mounting a piece of boat equipment therein;

said compartment means also for substantially reducing a tendency of said upper portion to rack or move laterally with respect to each said lower end when the boat encounters rough water.

4. A radar arch structure for connection onto a deck or superstructure of a boat comprising:

a rigid arch member formed of molded fiberglass or plastic and having a generally inverted U-shaped configuration, a leading edge and a trailing edge, and including a transverse upper portion generally spanning the width of the deck or superstructure and a pair of downwardly extending side portions each structured at its lower end for confection to the deck or superstructure;

a substantially enlarged stiffening portion of said arch member positioned and extending inwardly from an inner surface of each upper corner of said arch member, each said stiffening portion having a somewhat conical shape extending substantially between said leading and trailing edges and which is defined by smoothly blended substantially uninterrupted surface contours and a contiguous upright generally flat, transversely oriented panel;

each said enlarged stiffening portion substantially increasing the strength and rigidity of each said corner whereby a tendency of said upper portion to rack or move laterally with respect to each said lower end is substantially reduced.

* * * * *

UNITED STATES PATENT AND TRADEMARK OFFICE

CERTIFICATE OF CORRECTION

PATENT NO. : 5,669,325

DATED : September 23, 1997

INVENTOR(S) : Orville A. Feikema

It is certified that error appears in the above-indentified patent and that said Letters Patent is hereby corrected as shown below:

Column 6, line 4, replace "confection" with -- connection --.

Signed and Sealed this

Twenty-third Day of December, 1997

Bruce Lehman

*Attest:*

BRUCE LEHMAN

*Attesting Officer*

*Commissioner of Patents and Trademarks*